US006729860B1

(12) United States Patent
Markham et al.

(10) Patent No.: US 6,729,860 B1
(45) Date of Patent: May 4, 2004

(54) PNEUMATICALLY DRIVEN LIQUIFIED GAS BOOSTER PUMP

(75) Inventors: Trevor K. Markham, San Antonio, TX (US); Glen M. Arnott, New Braunfels, TX (US)

(73) Assignee: Daniel A. Holt, San Antonio, TX (US)

( * ) Notice: Subject to any disclaimer, the term of this patent is extended or adjusted under 35 U.S.C. 154(b) by 372 days.

(21) Appl. No.: 09/768,084

(22) Filed: Jan. 23, 2001

Related U.S. Application Data

(60) Provisional application No. 60/178,014, filed on Jan. 24, 2000.

(51) Int. Cl.[7] ..... F04B 35/02; F01L 31/02

(52) U.S. Cl. ..... 417/404; 417/403; 417/534; 91/330; 91/338; 91/346

(58) Field of Search ..... 417/397, 403, 417/404, 534, 398, 399; 91/337, 303, 346, 350

(56) References Cited

U.S. PATENT DOCUMENTS 1,964,005 A * 6/1934 Morton ..... 173/169
2,826,149 A * 3/1958 Wrigley ..... 417/225
2,862,478 A * 12/1958 Staats ..... 137/99
4,104,008 A * 8/1978 Hoffmann et al. ..... 417/397
4,659,294 A * 4/1987 Barthomeuf ..... 417/397
4,780,064 A * 10/1988 Olsen ..... 417/397
4,812,109 A * 3/1989 Yonezawa ..... 417/401
5,324,175 A * 6/1994 Sorensen et al. ..... 417/254
5,626,467 A * 5/1997 Cantley ..... 417/312
6,415,704 B1 * 7/2002 Wang ..... 91/224

* cited by examiner

*Primary Examiner*—Charles G. Freay
(74) *Attorney, Agent, or Firm*—Jackson Walker LLP

(57) ABSTRACT

Applicant provides a novel liquified booster pump. The pump takes high pressure boosted gas to a higher pressure. The pump is a pneumatically driven liquified gas booster pump with a shuttle valve enclosed within a body of the pump. Furthermore, the gas which is use to be boosted is carried from an inlet on the body of the pump to an outlet on the body of the pump, the boosted gas being carried entirely within the body of the pump with no external tubing. The pneumatically driven booster pump has a double ended piston within the central body and at least one shuttle valve incorporated in the piston for transferring gas from one side of the piston to the other.

14 Claims, 19 Drawing Sheets

PNEUMATICALLY DRIVEN LIQUIFIED GAS BOOSTER PUMP

This Application claims priority from U.S. application Ser. No. 60/178,014, filed Jan. 24, 2000.

FIELD OF THE INVENTION

An pneumatically driven liquified gas booster pump, more specifically described as a gas booster pump in which a shuttle valve is enclosed within the body of the pump and in which the driven or boosted gas is carried from an inlet to an outlet while entirely within the body of the pump. cl

BACKGROUND OF THE INVENTION

Applicant provides novelty in a liquified booster pump. The function of a booster pump is to take high pressure gas and boost it to a higher pressure. This is sometimes beneficial in handling liquified gas such as liquified $CO_2$ or $NO_2$ in the fire extinguishing industry, air conditioning industry, paint ball, beverage, automotive, motorcycle and industrial gas industry.

All booster pumps have a high pressure inlet and a higher pressure (boosted) outlet. All booster pumps contain some sort of check valves. Some booster pumps use a double acting piston which boosts the inlet pressure on both strokes (2 boosts or 2 strokes in one complete cycle). With a balanced pump, working on both strokes of the same cycle, greater efficiency is typically realized.

Applicant's pneumatically driven liquified gas booster pump includes a piston body which piston body includes a shuttle valve enclosed within the body for controlling the drive gas and also includes internal boosted gas supply and transfer passages. Prior art booster pumps would typically have external boosted gas supply passages and external shuttle valves. Applicants booster pump also includes unique cartridge style double check valves within the body thereof for moving the gas to be boosted from an inlet to an outlet.

The way in which Applicant's booster pump works is that a piston is driven by a drive gas, which piston engages a pair of chambers in fluid communication with the gas to be boosted. On a double acting, balanced booster pump the drive gas is shuttled from one side to the other side of the primary piston. A primary piston face, is say, 4 sq. inches. The secondary or booster piston faces are smaller, say 1 sq.inch, resulting in a quadrupling of the force applied to the primary piston face. For example, if the drive gas pressure is 100 p.s.i. acting on 4 sq.inches of primary piston face, an increase to 400 p.s.i. is realized on the boosted gas.

Applicant uses a cartridge style double check valve that encloses the springs, balls and other elements of the double check valve within a cartridge, which cartridge will drop into the housing with "o" rings between the body of the booster pump and the double acting check valve so that all the gas must flow through the body of the double check valve. This saves machining on the body of the pump.

Applicant also provides an externally or manually operated shuttle valve reset assembly in case the shuttle valve is locked in an "in between" or "stalled" position, and provides also a momentary on-off switch.

Applicant further provides, as part of a booster pump system, a fill valve, to provide boosted gas pressure to a container such as a fire extinguisher cylinder.

Large tanks of high pressure liquified gas, called mother tanks, are often used to fill smaller tanks, or nurse tanks. For example, a mother tank of $CO_2$ may be used to fill many smaller fire extinguishers. Likewise, a large $NO_2$ tank may be used to fill many smaller $NO_2$ tnaks.

In such a system, the weight of the nurse bottle is often used to determine if it has been filled. For example, it may be known that a specific bottle type will weight 15 Lbs. when filled with $NO_2$. When being filled from a mother bottle a booster pump may be used between the mother bottle and the nurse bottle. Periodic weighing of the nurse bottle during the filling process is required, often with the operator visually reading the weight from a scale and adding more gas as needed.

Applicant has further provided a consolidated system by joining a scale with a meter head display, in a package with the booster, hoses and valve.

DETAILED DESCRIPTION OF THE PREFERRED EMBODIMENT

Figure 1:
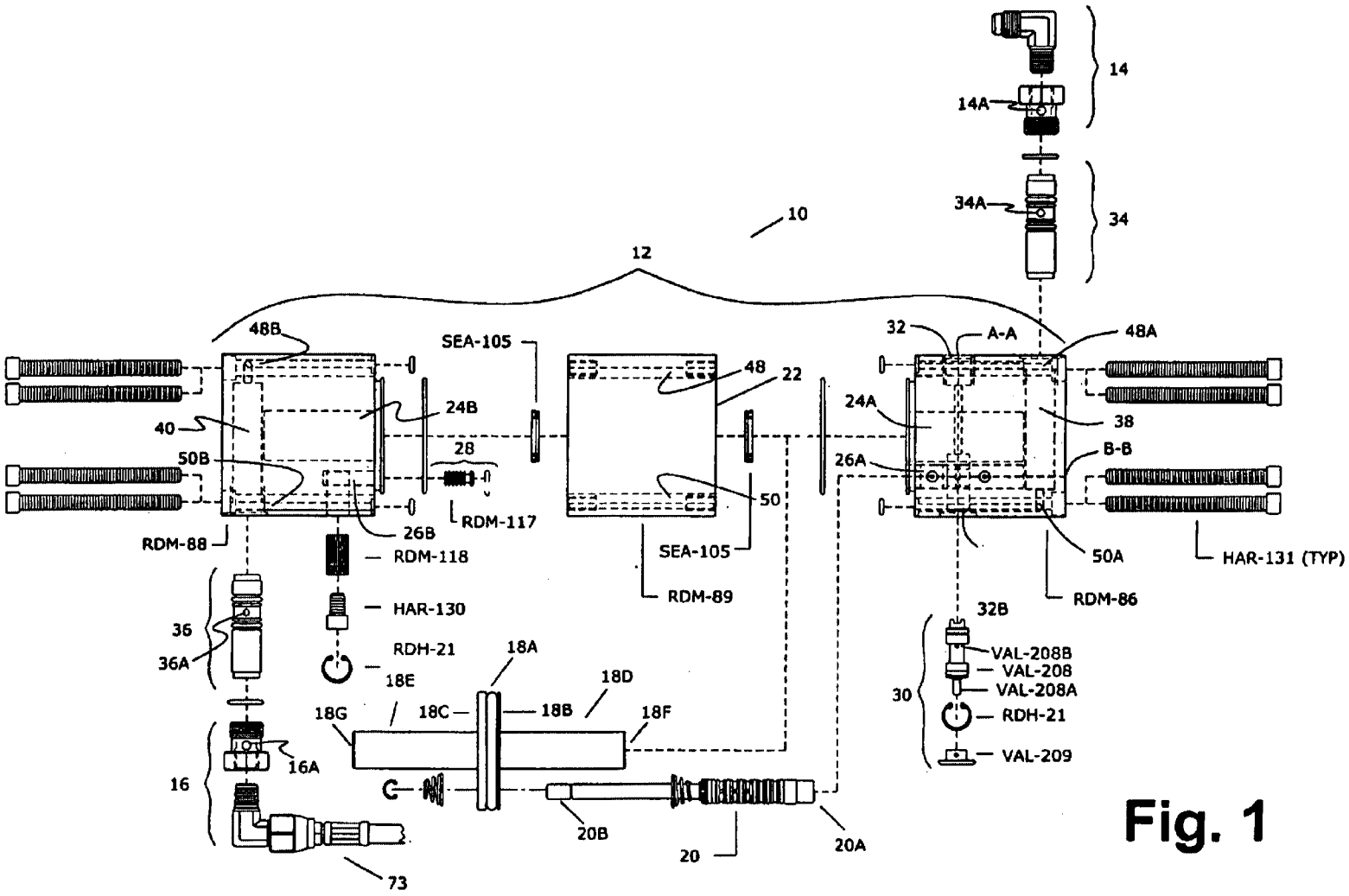
FIG. 1 is an exploded top elevational view of Applicant's booster pump.

FIG. 1 includes the major components of Applicant's booster pump 10. The body housing 12 is typically made of 2024 extruded aluminum in three pieces: in FIG. 1 RDM-86 (valved pump end body); RDM-89 (center pump body) and RDM-88 (unvalved pump end body). The three body pieces are typically held together by four hex head machine screws coming in from each end of the body and into the center body pump illustrated in FIG. 1 as HAR-131.

External to the body housing 12 and engaged therewith Applicant provides a high pressure gas inlet assembly 14 and a boosted gas outlet assembly 16. These two assemblies are in fluid communication with the body as set forth in more detail below. The booster pump will take high pressure gas at the inlet and provide boosted pressure at the outlet.

Partially external to the body housing, and engaged therewith, Applicant also provides drive gas engagement assembly 30 which includes button VAL-209, the depression of which will supply drive gas to the pump to activate the pump. Optionally, partially external to the body housing and engaged therewith is threaded bolt HAR-130, the rotation of which will manually move the shuttle valve from a "stalled" position to an operating position. The operation of these parts will be explained in more detail below.

Also illustrated in FIG. 1 are the parts of Applicant's booster pump 10 that are enclosed within the body housing 12. Here, Applicants provide a primary pump piston assembly 18 and a piston shuttle valve assembly 20. The primary pump piston assembly 18 includes a drive piston 18A having opposed drive faces 18B and 18C and two opposed driven pistons 18D and 18E, each one with a driven piston face 18F and 18G. The entire primary pump piston assembly 18 is integral and moves within the chambers of the body housing as set forth in more detail below. Cooperating and engaged with the primary piston pump assembly 18, more specifically with drive piston 18A by being slidably mounted thereto, is piston shuttle valve assembly 20, the function of which is to controllably shuttle the drive gas from one side of drive piston 18A to the other.

Turning back to the primary pump piston assembly 18 it is seen to fit within body housing 12. More specifically center pump body RDM-89 is machined to snuggly receive the drive piston, typically having an "o" ring 18H engaged therewith so as to slideably seal against the walls of the body housing. Optionally, the drive piston "o" ring may be covered with a teflon cap seal to prevent rolling of the "o" ring (See FIGS. 10C and 10D). The drive piston may move back and forth in a drive piston chamber 22, seen in FIG. 1 typically cylindrical and slightly larger in diameter than the diameter of drive piston 18A. Likewise, both valved RDM-86 and unvalved RDM-88 end bodies are machined to create driven pistons chambers 24A and 24B, to receive the driven pistons 18D and 18E therein. "O" rings (or lip seals) are used throughout to create gas sealing while allowing primary pump piston assembly to move back and forth within the body.

It is also seen, with reference to FIG. 1 that the two end bodies RDM-86 and RDM-88 have shuttle valve chambers 26A and 26B to receive the ends 20A and 20B of the shuttle valve 20. Note, as it will be explained in more detail below, that shuttle valve chamber 26A is threaded at the near end thereof to receive the cartridge.

Optionally, applicant's shuttle valve engagement assembly 28 will allow the manual rotation of threaded bolt HAR-130 to move end 20B of piston shuttle valve assembly 20. This occurs as, at the removed end of threaded bolt HAR-130 there is a grooved shaft RDM-118, acting as a pinion gear to drive threaded rack RDM-117. One end of the threaded rack contacts the pinion gear and the other end contacts end 20B of piston shuttle valve assembly 20. More details on this follow.

Applicant's use a drive gas engagement assembly 30, partially insertable into valved end body RDM-86. This assembly includes button VAL-209, retainer clip RDH-21 and valve VAL-208. Valve VAL-208 is available as an off the shelf item available from a number of sources. Button VAL-209 acts against the protruding arm VAL-208A of Valve VAL-208 (which is spring loaded) to depress the arm and thereby allow the drive gas to move through drive gas inlet port 32 out port VAL-208B, through inlet port 44 (See FIG. 2A) and into shuttle valve chamber 26A. So long as the button is depressed the pump will operate. Release of the button by the operator will cause pumping to cease.

Figure 4A:
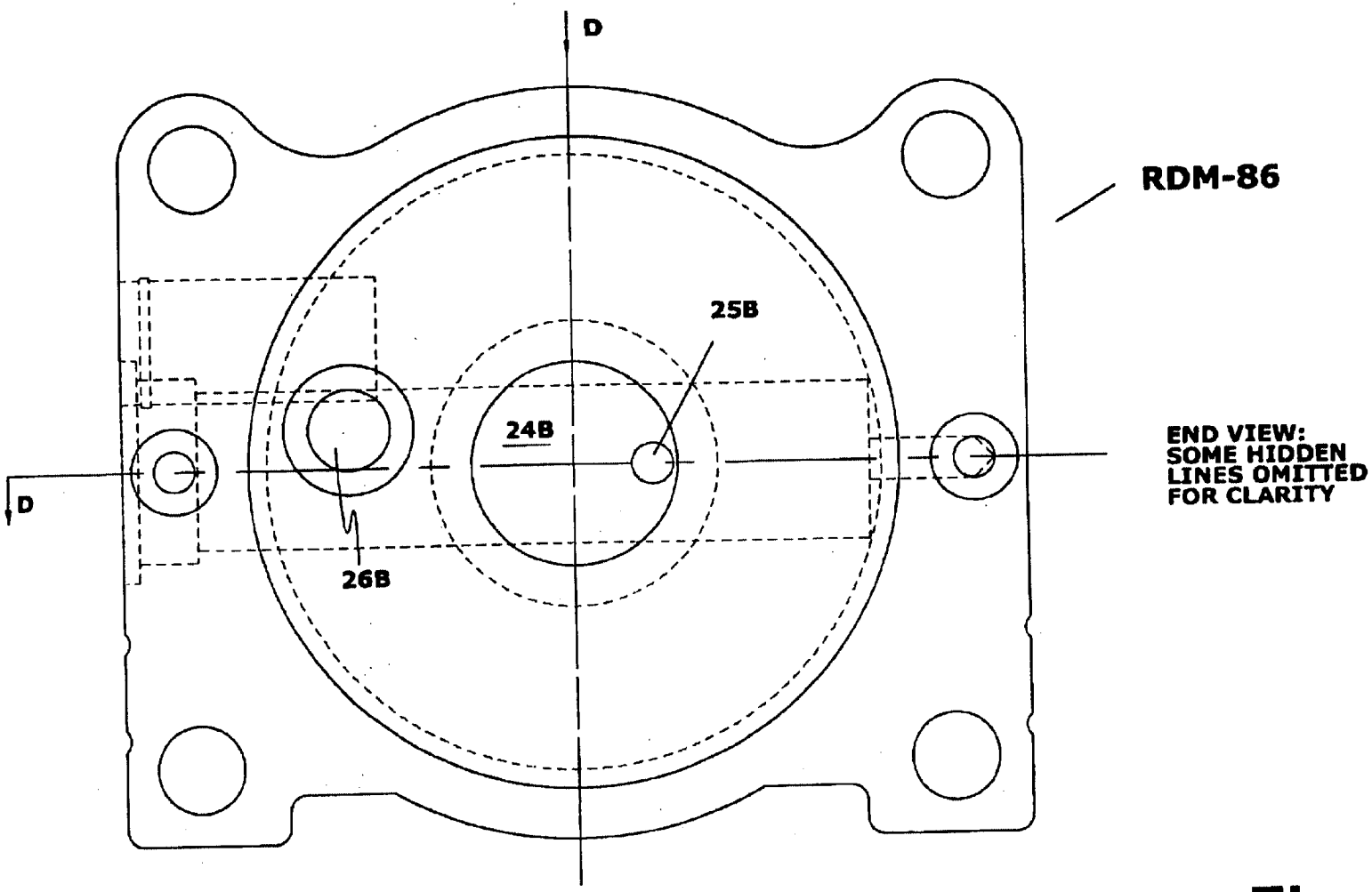
FIG. 4A (viewed from the inside looking out), 4C (side elevational) and 4D (quarter section top elevational view D:D) are elevational views of the unvalved pump end block body of Applicant's 3 piece body housing 12 (there is not FIG. 4B).
Figure 4C:
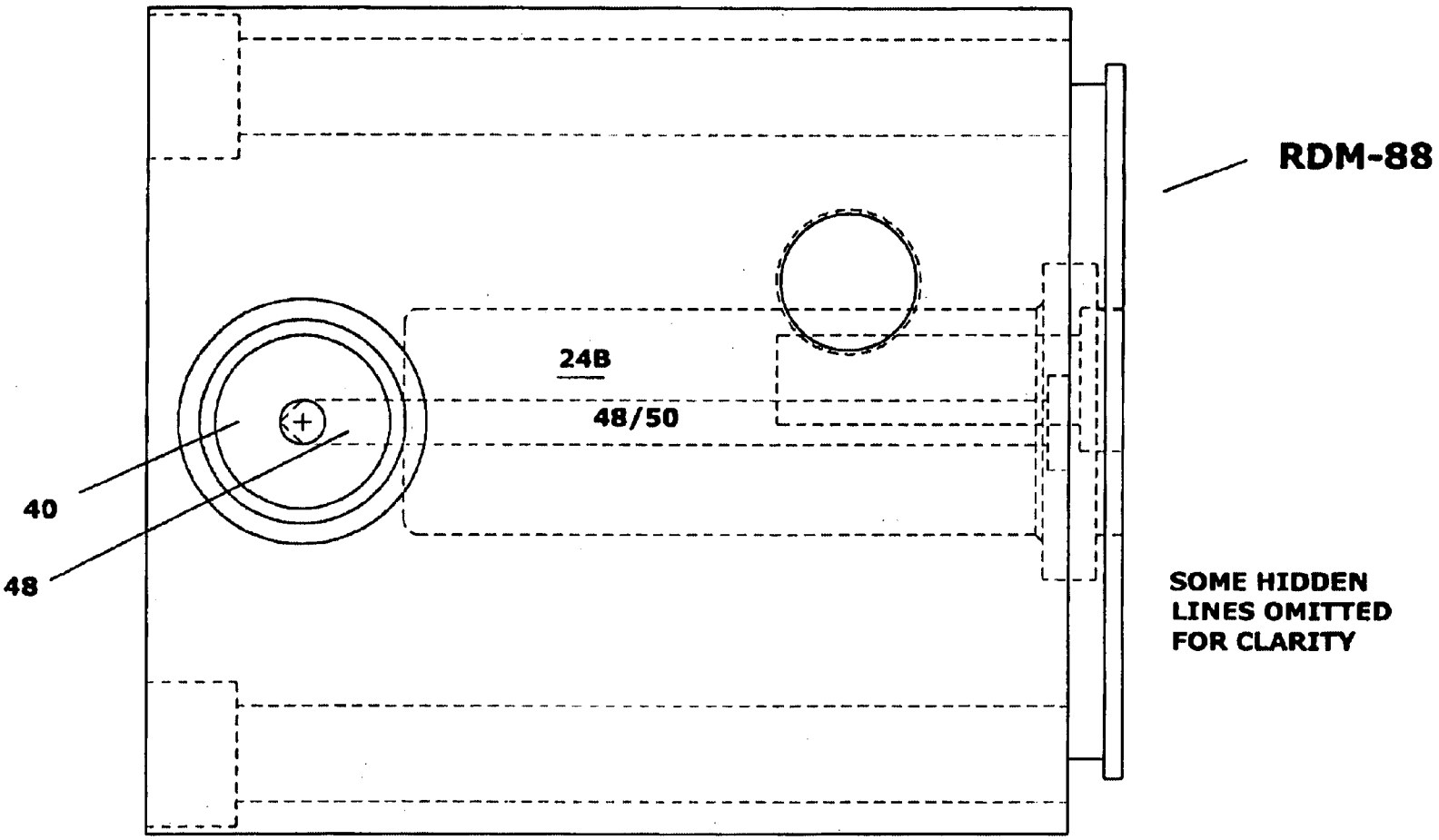
Figure 4D:
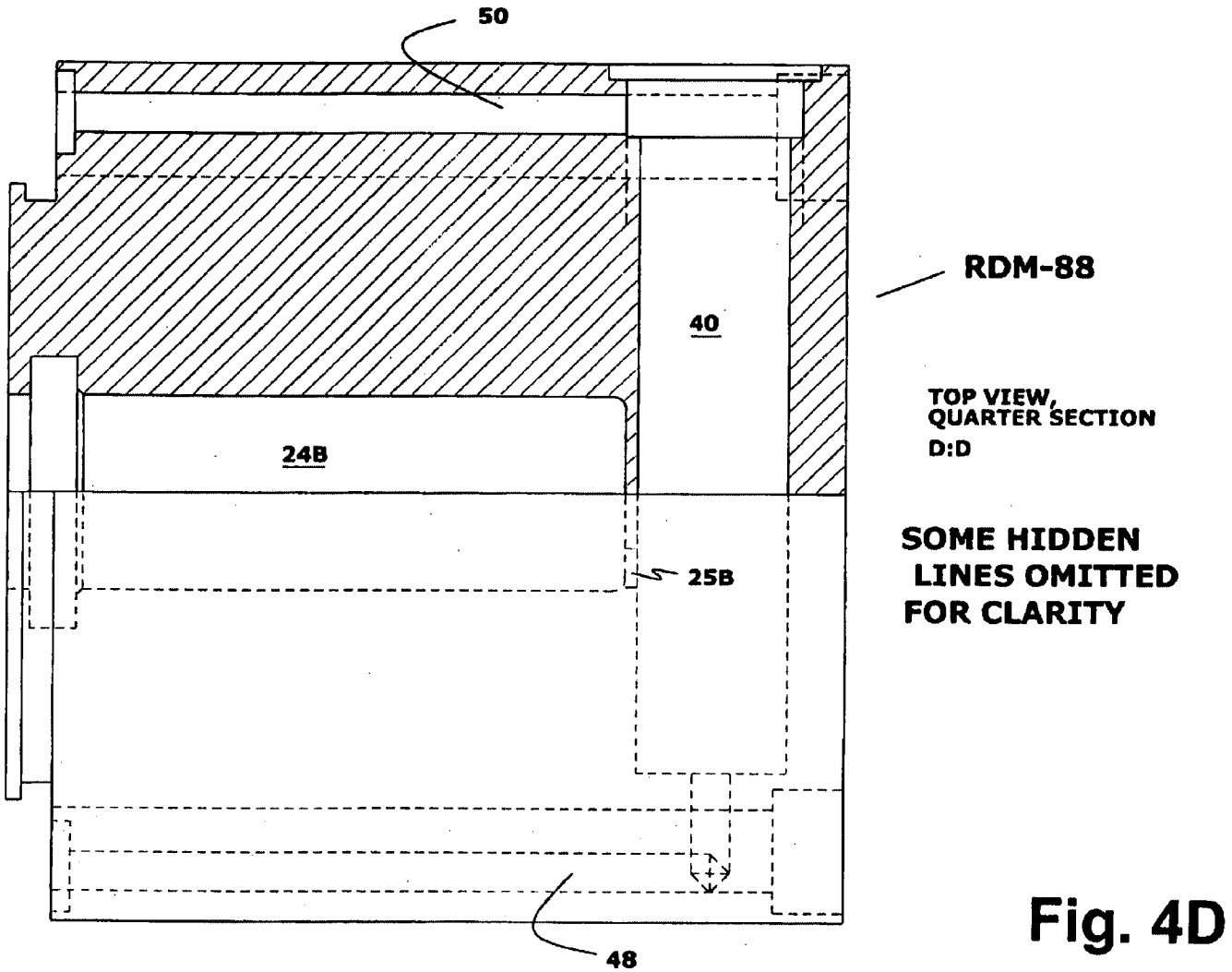

Applicant provides a pair of double check valve assemblies 34 (adjacent inlet) and 36 (adjacent outlet) Details of these will follow (See FIGS. 11A and 11B) below but note that they may be cartridges, dimensioned for receipt into valved chambers 38 (adjacent inlet) and valved chamber 40 (adjacent outlet). The two valved chambers are in fluid communication with their respective driven piston chambers 24A and 24B, through ports 25A (See FIG. 2B) and 25B (See FIG. 4A) so as to valve gas alternately under suction and compression within either chamber, through the respective double checked valve 34 and 36 assemblies as set forth in more detail below.

The remaining machining of the body housing is best understood with reference to FIG. 1 in conjunction with FIGS. 2A, 2B, 2C, 2D, 3, 4A, 4C and 4D.

Turning now to the valved pump end body RDM-86 and FIGS. 1 and 2A, 2B, 2C and 2D, it is noted that these illustrate various elevational views and will help understand the gas flow through the pump.

Drive gas comes into the valved end body at drive gas inlet port 32 from an appropriate fitting, through channel 32A and enters drive gas assembly chamber 32B, engages, and while in operation, passes through port VAL-208B, then through inlet port 44 to engage the shuttle valve and exhausts at either drive exhaust port 42A or 42B (See FIG. 2A) as set forth in more detail below. Shuttle valve end chamber 26A receives pressurized drive gas from inlet port 32 through valve VAL-208 through inlet port 44 to pressurize shuttle valve chamber 26A, when button VAL-209 is depressed. The shuttle valve chamber 26A supplies a drive gas alternatively to both piston faces 18B and 18C (that is, into center pump body RDM-89) as set forth in more detail below.

Again, with reference to FIGS. 1, 2A, 2B, 2C and 2D, and further with reference to FIGS. 3, 4A, 4C and 4D, Applicant will provide details of the passages, vents, ports etc. that carry the driven or boosted gas from the intake assembly through the double check valves and, as boosted gas through the outlet assembly 16.

Turning now to FIGS. 1, 2C, 3 and 4D, details of the manner in which the driven gas is moved through the body may be appreciated. More particularly, it is seen that the three body parts provide for driven (boosted) gas to be carried through the body along the high pressure passageway 48 or boosted gas passageway 50. The double check valves operate in conjunction with the pneumatically driven primary pump piston assembly 18 to alternately fill driven piston end chambers, which are pressurized as driven pistons 18D and 18E alternately subject chambers 24A and 24B to pressure and suction, through each cycle of primary piston pump assembly 18.

Turning now to FIG. 1 it is seen that high pressure passageway 48 has a first end 48A at high pressure inlet, to align with port 14A in the high pressure gas inlet assembly 14, thus providing high pressure gas to valved chamber 40 through high pressure passageway 48. Ports 34A and 36A of the respective double check valve assemblies provide suction pressure to chambers 38 and 40 respectively. Port 34A draws gas through the inlet assembly 14 and upper end of check valve 34 when driven piston 18D begins to move away from valved chamber 38 (suction). When driven piston 18E begins to move away from valved chamber 40 suction develops in chamber 40 drawing gas through the upper end of check valve assembly 36. On the other end port 34A will vent driven piston chamber 24A when driven piston 18D begins to compress gas in driven piston chamber 24A, and such compressed gas will pass out through the lower end of double check valve assembly 34 at first end 50A of boosted pressure passageway 50, to pass through the body and out at port 16A of outlet port assembly 16. The same action occurs at the other end of the pump as the piston reverse direction and piston chamber 24B is under compression. Thus, the pump is "double acting," boosting pressure at one drive piston chamber on each stroke of a two stroke cycle, while intaking gas at the other drive chamber. Thus it is seen that all the boosted gas must pass through one of the two double check valves.

Next, it remains to be explained the function of piston shuttle valve assembly 20 and related structure to explain how Applicants provide an internal shuttle valve to drive primary piston pump assembly 18. This should be done with reference to FIGS. 1, with FIGS. 5A, 5B, 5C, 6 and FIG. 7. Optionally, See FIGS. 10C and 10D for an alternate preferred embodiment.

Figure 7:
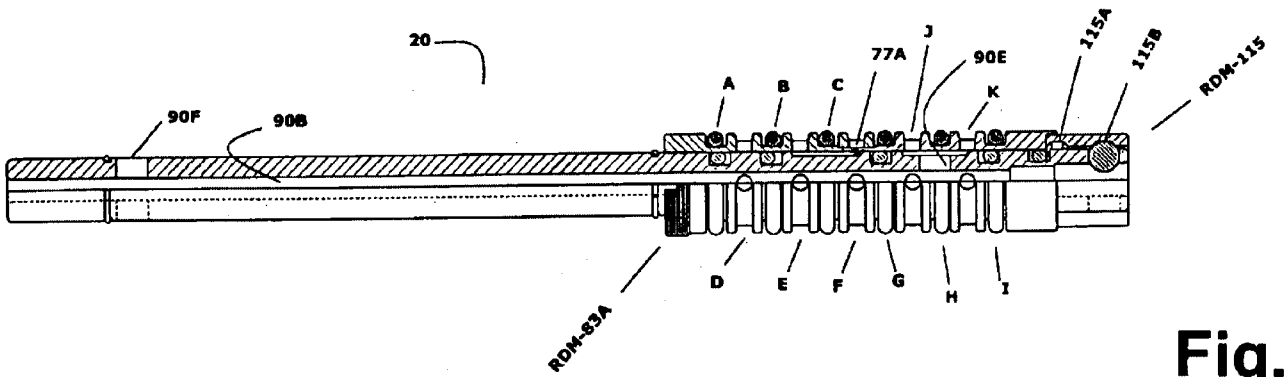
Figures 10A, 10B:
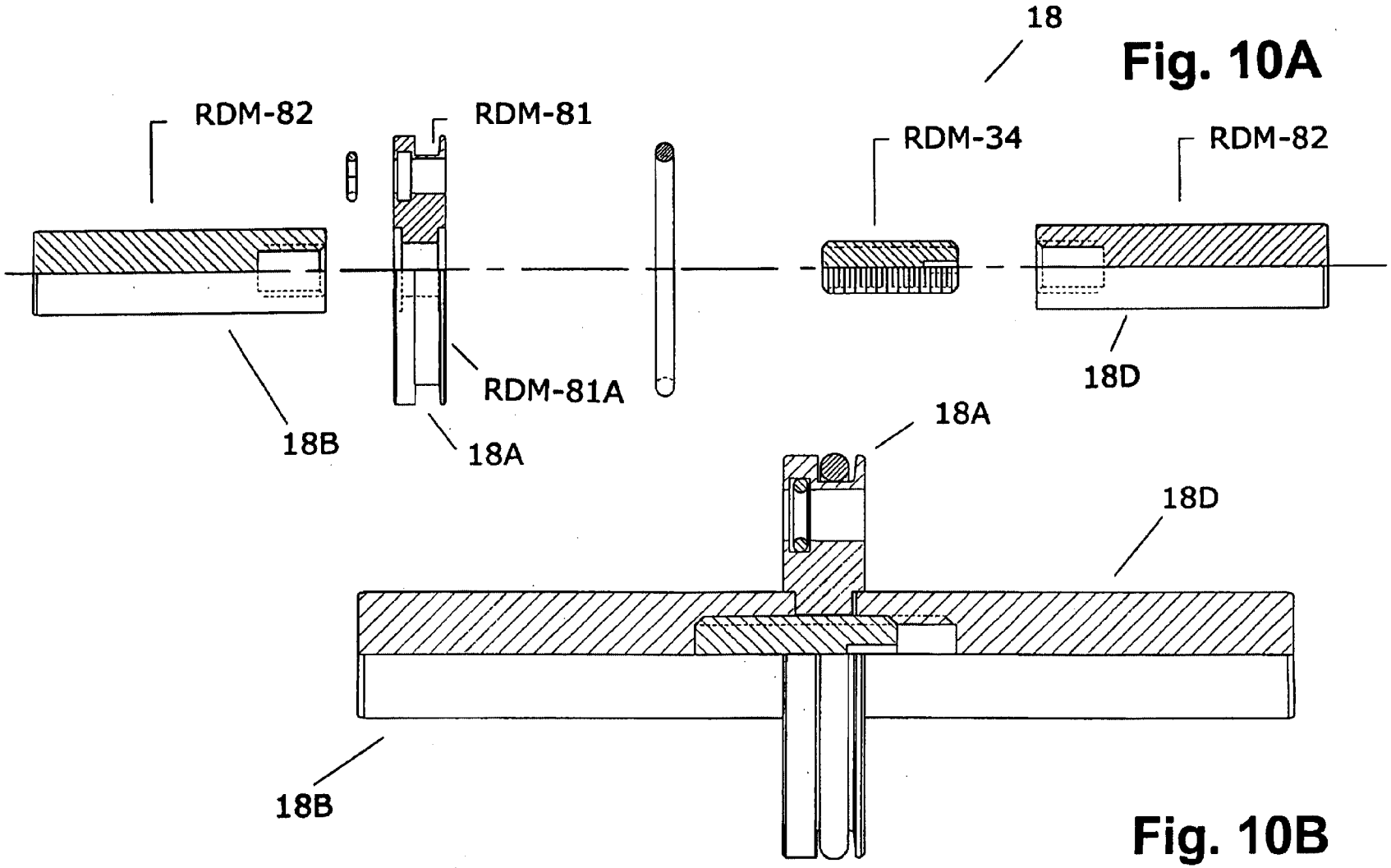
FIGS. 10A and 10B show the details of Applicant's primary piston pump assembly and how it may be assembled from several pieces.
Figure 10C:
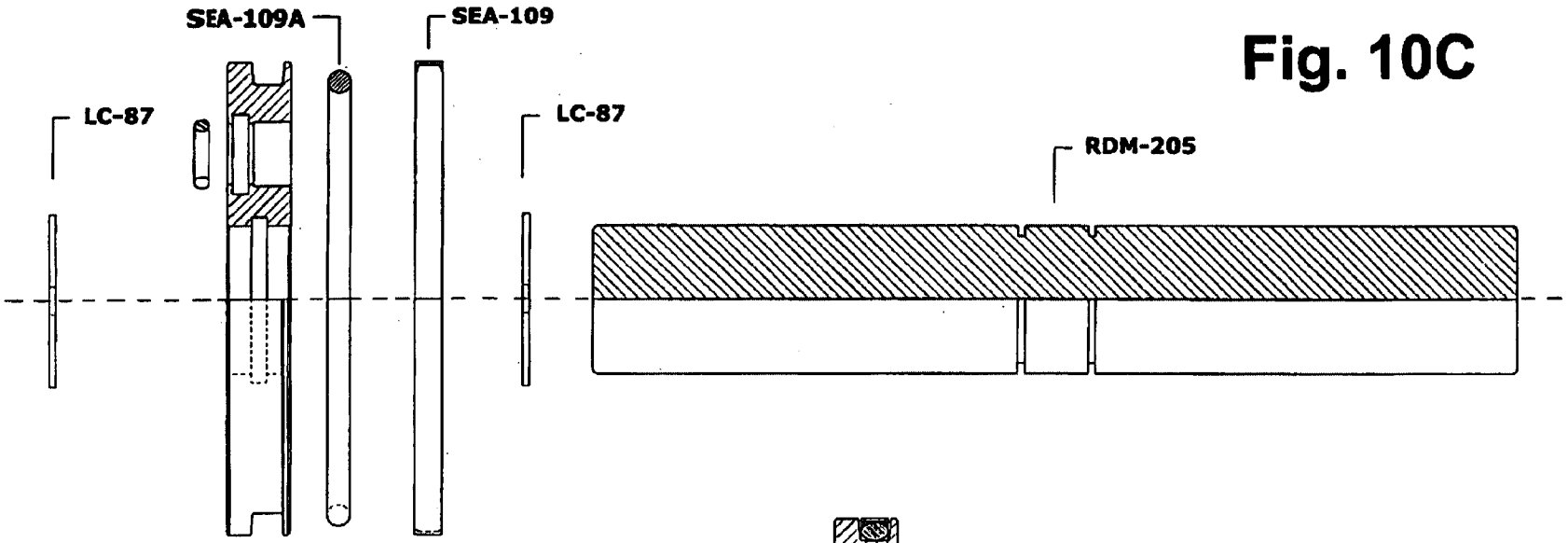
FIGS. 10C and 10D illustrate the alternate preferred embodiment of the primary piston pump assembly.
Figure 10D:
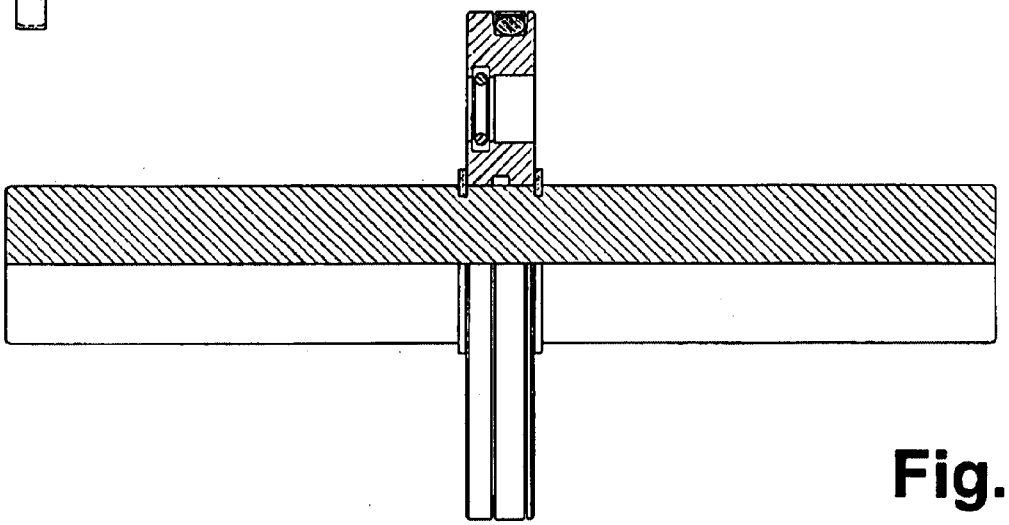

Piston shuttle valve assembly 20 includes cartridge stem RDM-90 onto which a 3 piece cartridge 61 is slidably received, the 3 piece cartridge being made up of a cartridge screw body RDM-83, a cartridge ring RDM-77 and a cartridge body RDM-79 (These 3 pieces can be manufactured as a single assembly, see FIGS. 10C and 10D). These are cylindrical, typically machined from brass, to slide over a body portion RDM-90A of cartridge stem RDM-90. Cartridge detent body RDM-115 fits into the end of cartridge body RDM-79 as seen in FIG. 7.

Cartridge screw body RDM-83 has three "o" ring groves: A, B and C and two vented grooves D and E. Cartridge ring RDM-77 is comprised of a vented grove F and cartridge body RDM 79 has "O" ring groves G, H and I and vented groves J and K. Cartridge screw body RDM-83 has threaded section RDM-83A which will thread into walls at the removed end (left end as viewed in FIG. 1) of shuttle valve chamber 26A. Ball detent body RDM-115 fits into the removed end of cartridge assembly 61 and includes on the interior walls thereof, ball detent grooves 115A and 115B.

Cartridge stem RDM-90 has a central channel 90B running through entire cartridge stem with removed ends 90C and 90D. The central channel is vented at ports 90E and 90F and has two holes cutting through the walls at 90G and 90H for holding the 2 detent balls 101A and 101B illustrated in FIG. 6. (Alternate preferred embodiment, See FIGS. 14 and 14A). The spring RDH-100 is fittable into end 90C of cartridge stem RDM-90 into which detent pin RDM-78 will fit, to act against the two balls 101A and 101B as illustrated in FIG.7 to normally maintain the cartridge stem in one of the two grooves 115A or 115B. Note that cartidge stem RDM-90 has 5 "O" ring grooves 90I, 90J, 90K, 90L and 90M, for receipt of "O" rings thereon. Further, the stem has bays 90N and 90O which are located in the exterior walls of the stem with bay 90O vented by port 90E.

Before turning to the operation of the shuttle assembly it must be pointed out that shoulders L and M on screw body RDM-83 and cartridge body RDM-79 respectively are dimensioned to receive the opposed outer walls of cartridge ring RDM-77 such that when the 3 pieces of the cartridge 61, RDM-83, RDM-77 and RDM-79 are pushed together as they would be when threaded into the end chamber 26A of valved pump end body RDM-86, an annulus or circular gap 77A is created. This gap will allow the passage of gas therethrough. The retainer clip and springs shown on FIGS. 1 and 7 (clips only on FIG.7) complete the structure of the piston shuttle valve assembly 20.

Figures 5A, 5B, 5C:
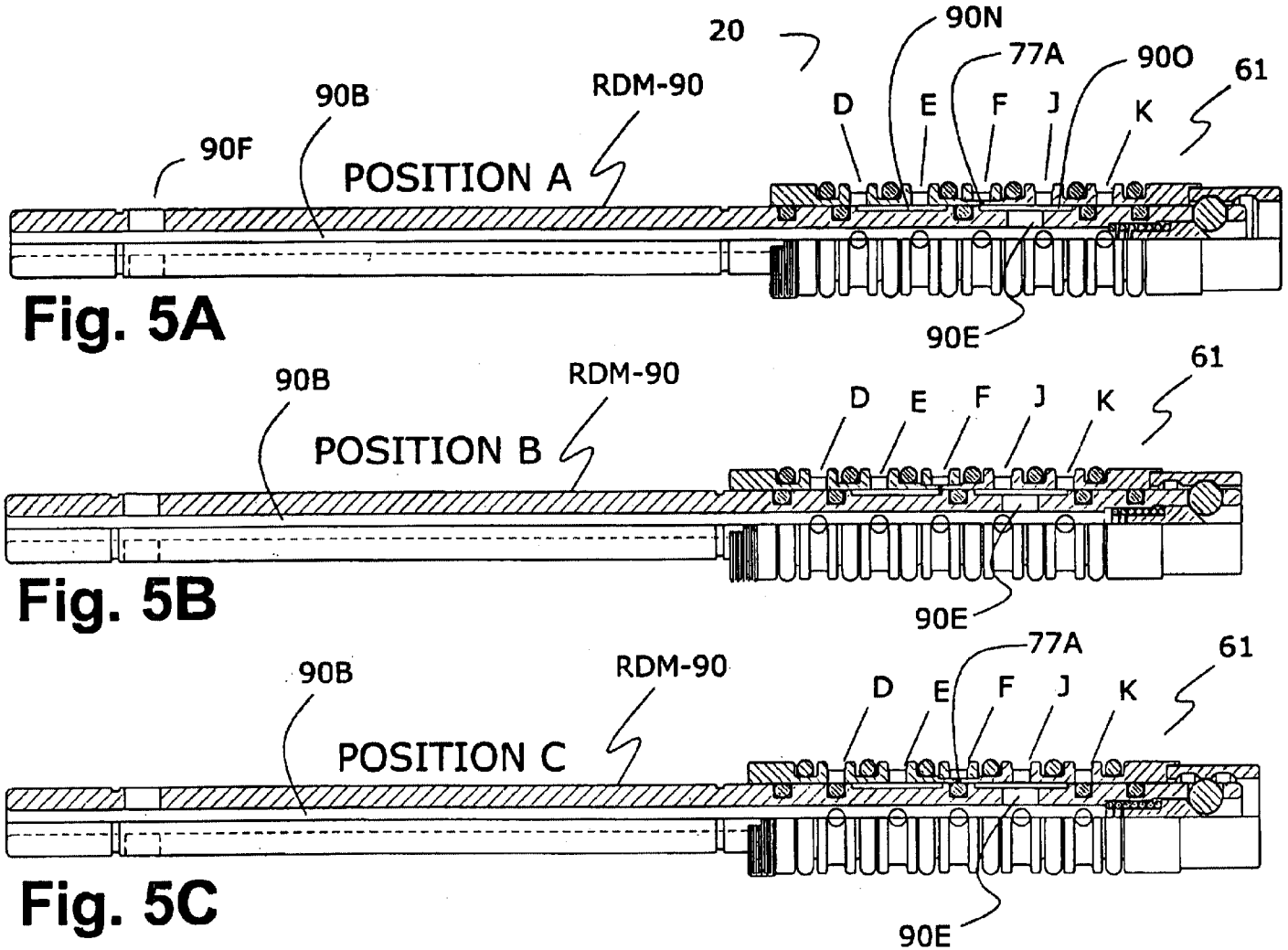
FIGS. 5A, 5B and 5C illustrate the 3 possible positions of Applicant's cartridge, that control which end of the piston assembly the drive gas will enter.

Turning now to FIGS. 5A and 5B it is noted positions A and position B differ with respect to the position of the cartridge 61 with respect to the stem RDM-90. A close examination of position A (as set forth in FIG. 5A) will show that gas can pass through ports in vented groove F, bay 90O through 90E and into central channel 90B. On the other hand, in position B (as illustrated in FIG. 5B) gas can pass through the annulus 77A and out vented groove E.

Figure 2A:
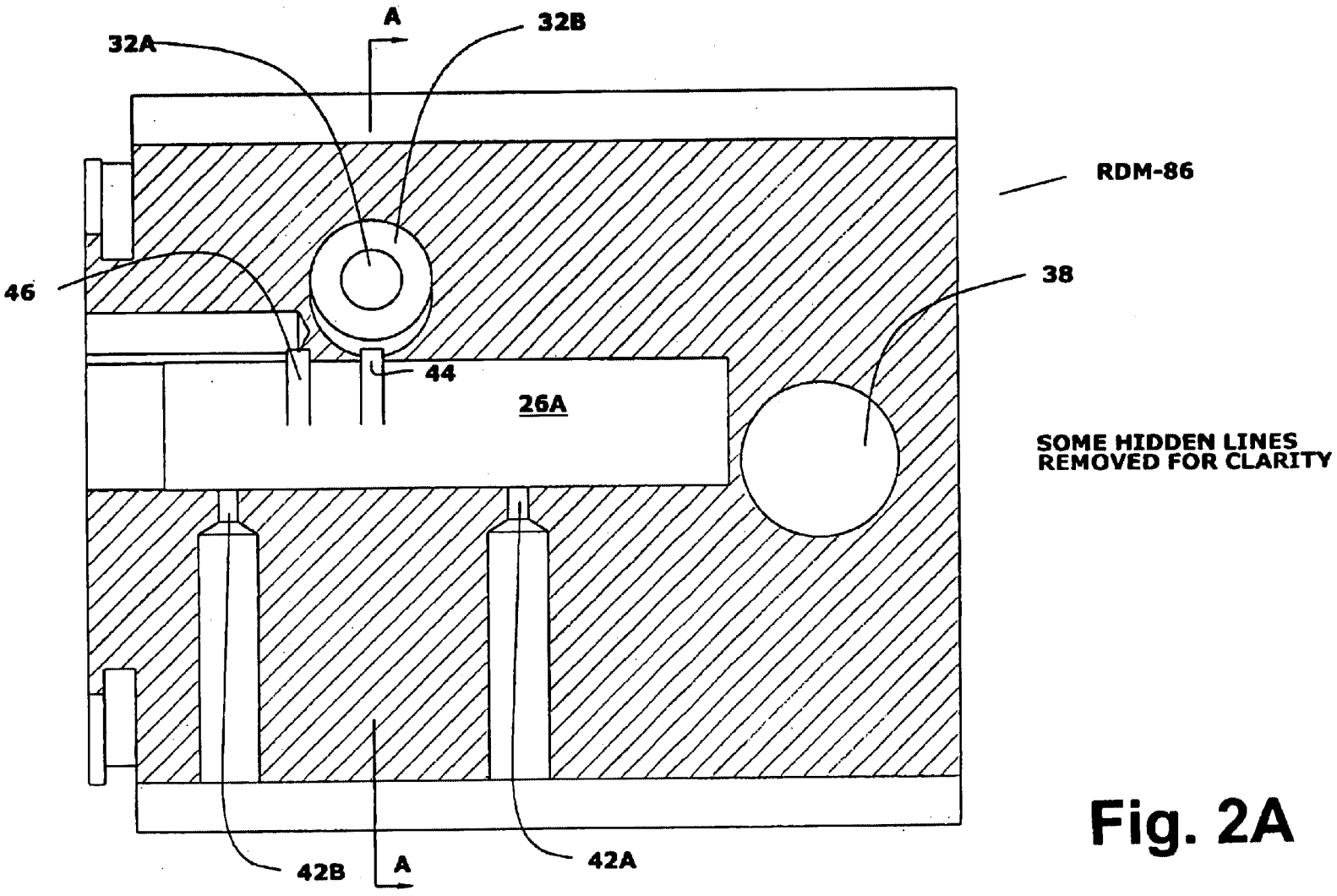
FIG. 2A (cross section through B:B), 2B (end from the inside), 2C (quarter section view) through C:C and 2D are all elevational views of the valved pump end block body, one of the three body parts of Applicant's booster pump body housing 12.
Figure 2B:
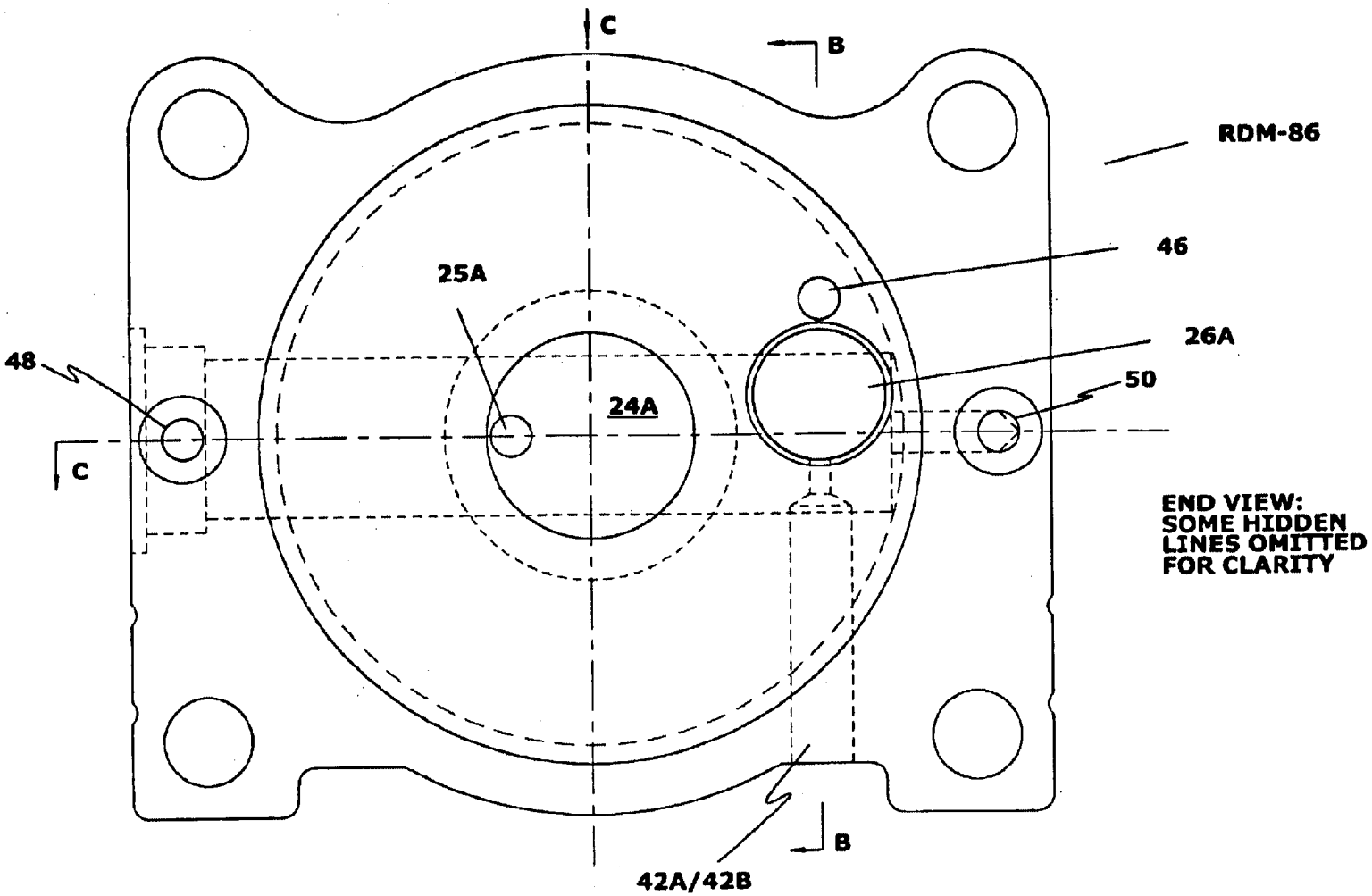
Figure 2C:
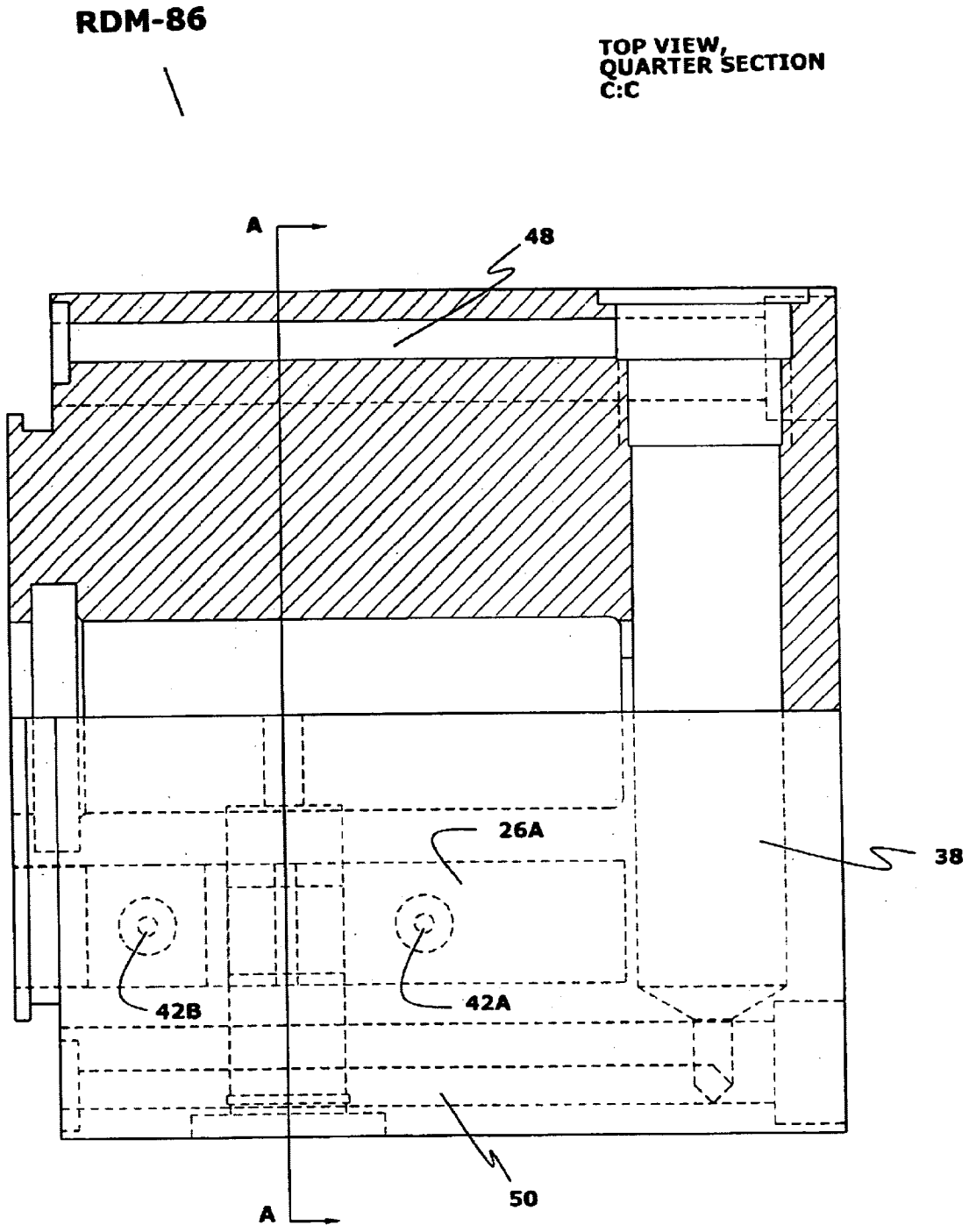
Figure 2D:
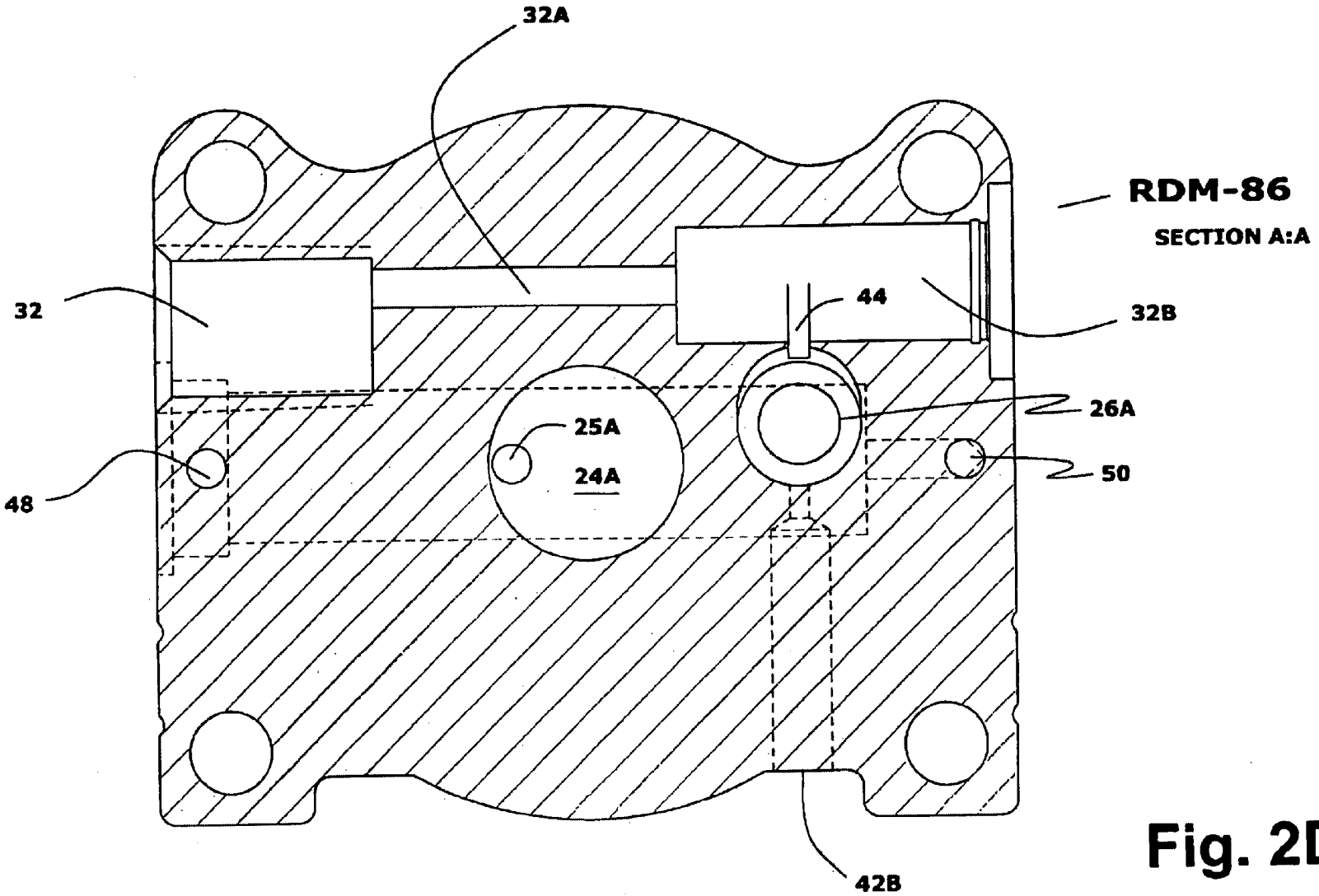
Figure 3:
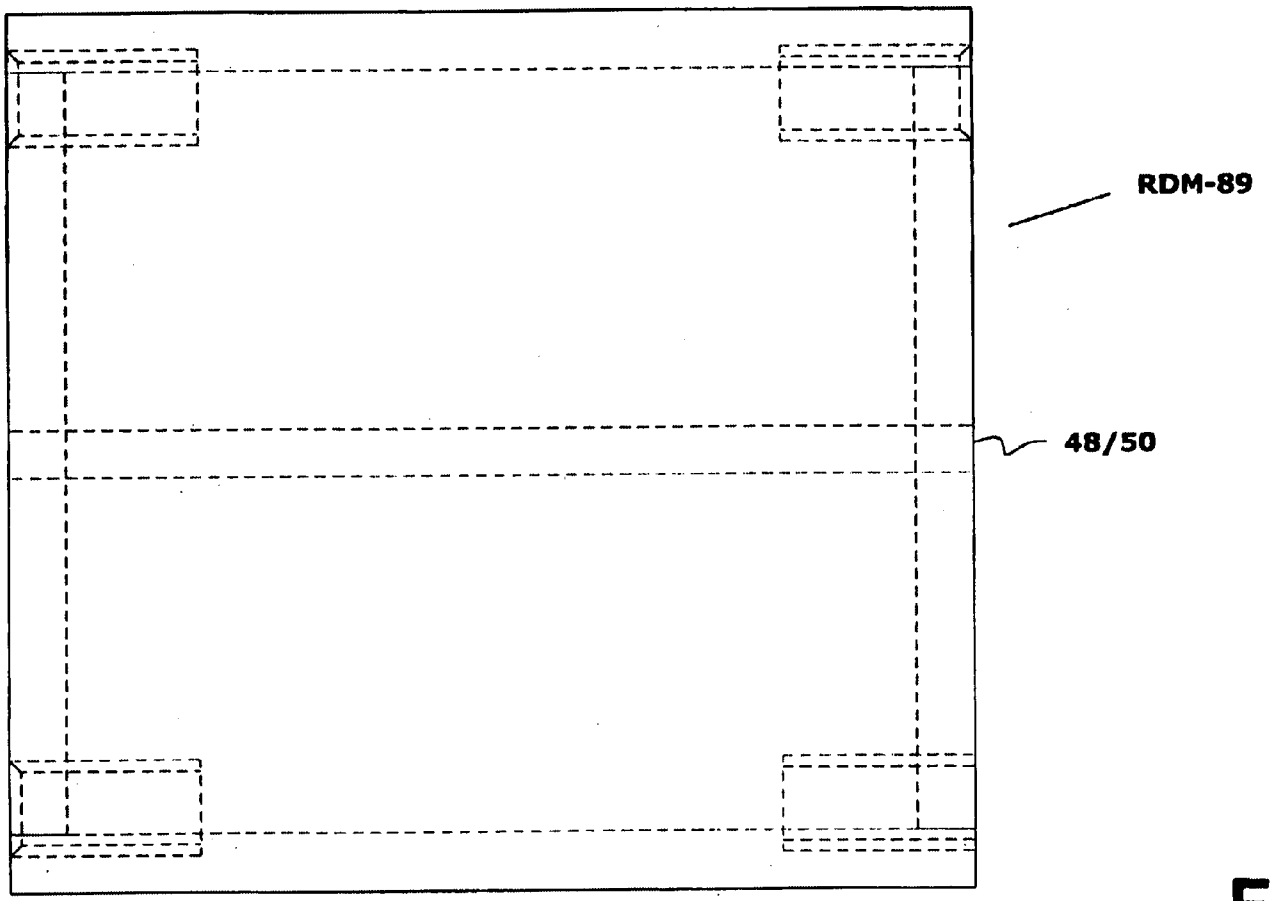
FIG. 3 is an side elevational side view of the center pump body of Applicant's body housing 12.

When the cartridge 61 is threaded into the shuttle valve end chamber 26A note the following alignment of vent grooves, with reference to FIG. 2A: drive gas exhaust port 42B aligned adjacent vented groove D; vented groove E aligned adjacent port 46; vented groove F aligned adjacent inlet port 44 and vented groove k aligned adjacent drive gas exhaust port 42A. Vented groove J is not necessary to the operation of the shuttle valve.

It is understood that stem position A results when piston assembly 18 has moved to the left (as seen in FIG. 1) and that stem position B results when piston assembly 18 has moved to the right, as a result of the action of faces 18C and 18B respectively on the spring and retainer clip of stem RDM 90.

When button Val-209 is depressed and drive gas fills shuttle valve chamber 26A and the stem is in position A, drive gas will enter through vented groove F, and the annulus 77A from inlet port 44 and proceed into central passageway 90B through port 90E to pressurize the piston chamber from port 90F so as to assert force against face 18C. This will allow the piston assembly to move to the right as seen in FIG. 1, while the gas on the right side of piston body 18A will escape through port 46, into vented groove E across bay 90N, through vented groove D and out exhaust port 42B. Nearing the end of its movement to the right, face 18B will act on stem RDM-90 (against spring and retainer clip) to move it to position B. Now, from position B note drive gas in chamber 26A will pressurize face 18B when it rushes through vented groove E and port 46. When piston body 18A moves in response to this, to the left, as set forth in FIG. 1, gas will leave that end of the primary piston chamber through center channel 90B, port 90E and out exhaust port 42A.

Thus, the piston moves back and forth so the shuttle assembly alternatively pressurizes one side of the piston body while venting the other.

Note that if the piston is "stalled" at the position indicated in FIG. 5C (annulus over an "O" ring), one may rotate threaded bolt HAR-130 which will bump the stem off the the "O" ring. After that is done one should rotate HAR-30 back to its original position.

Figures 8, 8A, 9:
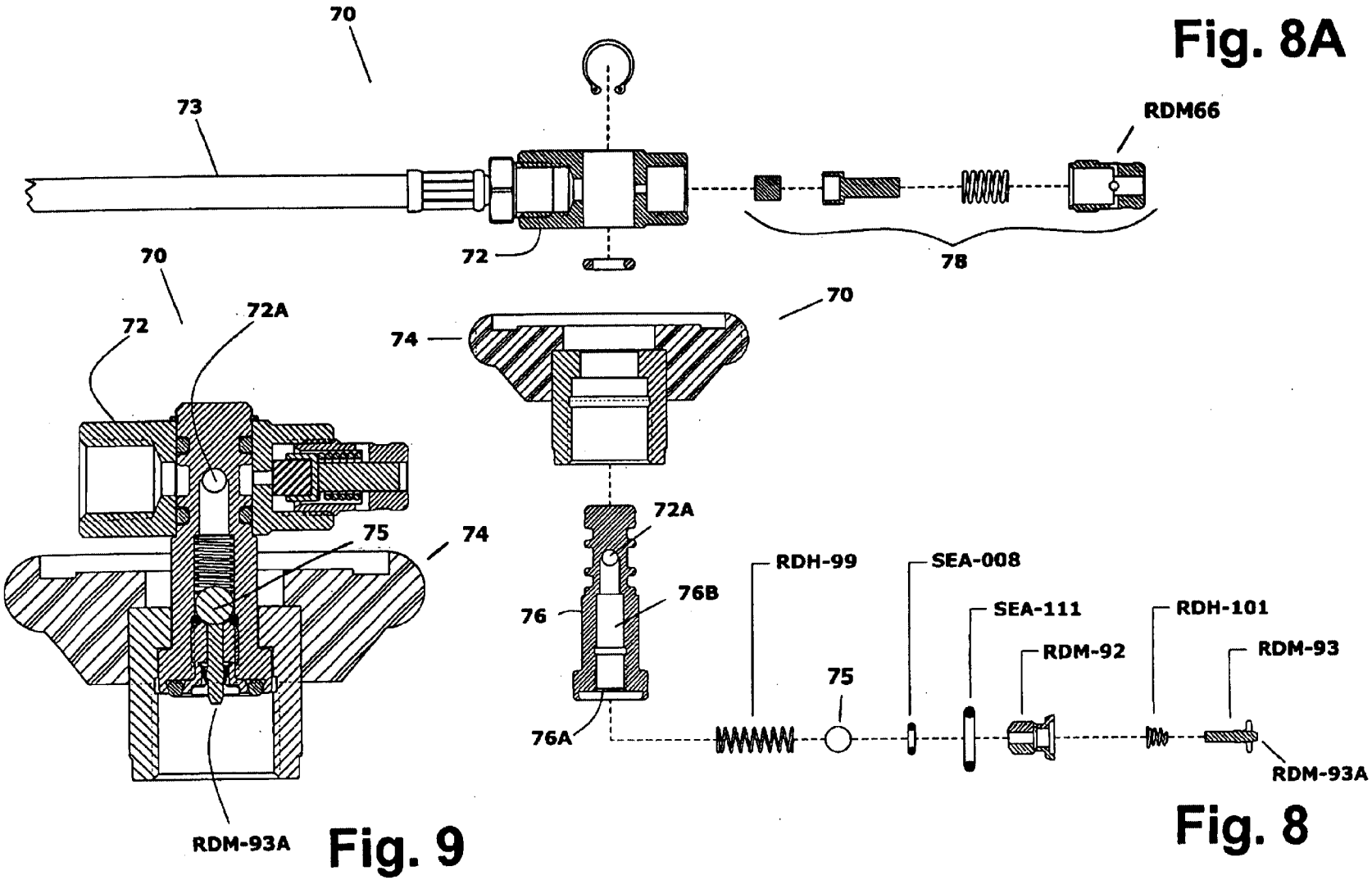
FIGS. 8 and 9 are views of the fill valves which are attached to a line connecting to the boosted gas outlet assembly.

FIGS. 8, 8A and 9 show a nursing cylinder engaging fill valve 70. The function of the nursing cylinder engaging fill valve is to shut off the boosted gas pressures provided to a nursing cylinder at the point of use. It is attached to the removed end of a line 73 attached to boosted gas outlet assembly 16, (See FIG.1) at swivel connector housing 72. Hand wheel 74 and stem 76 slideably engage and cooperate with swivel connector housing 72. Spring RDH-99, stainless steel ball 75, "O" rings SEA-008 and SEA-111, retaining screw RDM-92, retaining spring RDH-101 and activator pin RDM-93 complete the assembly that is threaded into end 76A of stem 76. As illustrated in FIG. 9 boosted pressure gas has seated the ball against "o" ring SEA-008. However, when the user threads fill valve 70 onto a nurse container, by rotating hand wheel 74, removed end RDM-93A contacts the valve of the nurse cylinder to be filled. Boosted gas will then move through port 72A through chamber 76B and into the nurse cylinder to be filled. Safety valve assembly 78 completes the fill valve and can be adjustably set by threadably adjusting body RDM-66 into swivel body 72.

Figure 9A:
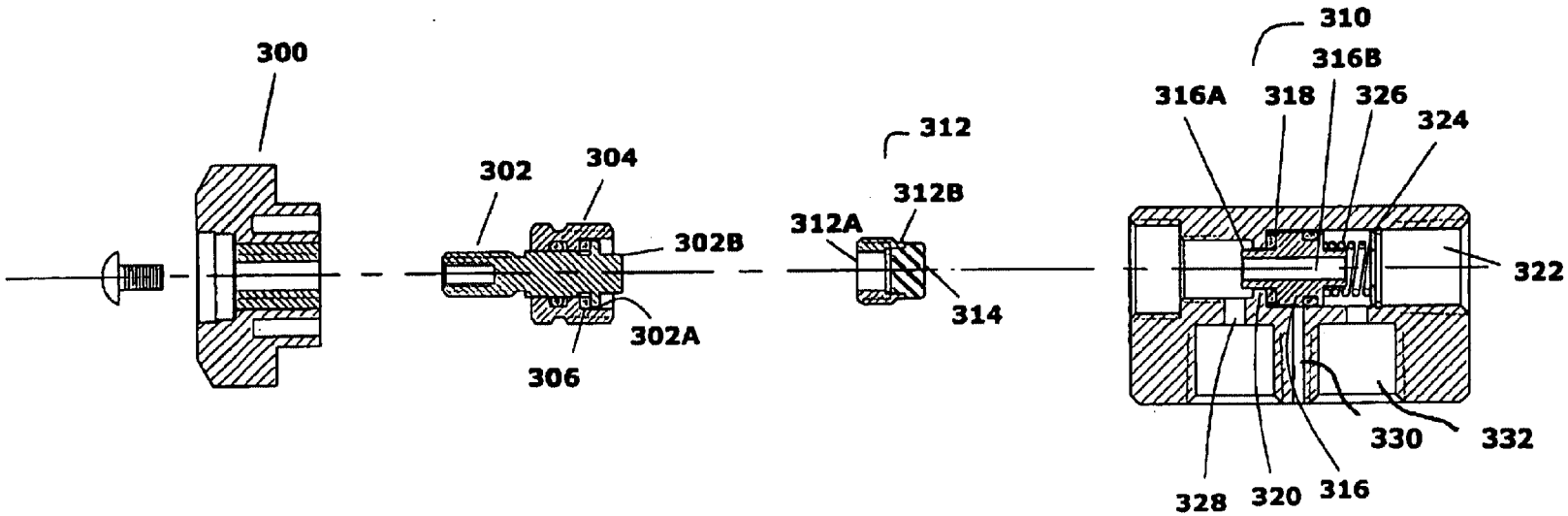
FIGS. 9A and 9B illustrate an alternate preferred embodiment of Applicants fill valve.
Figure 9B:
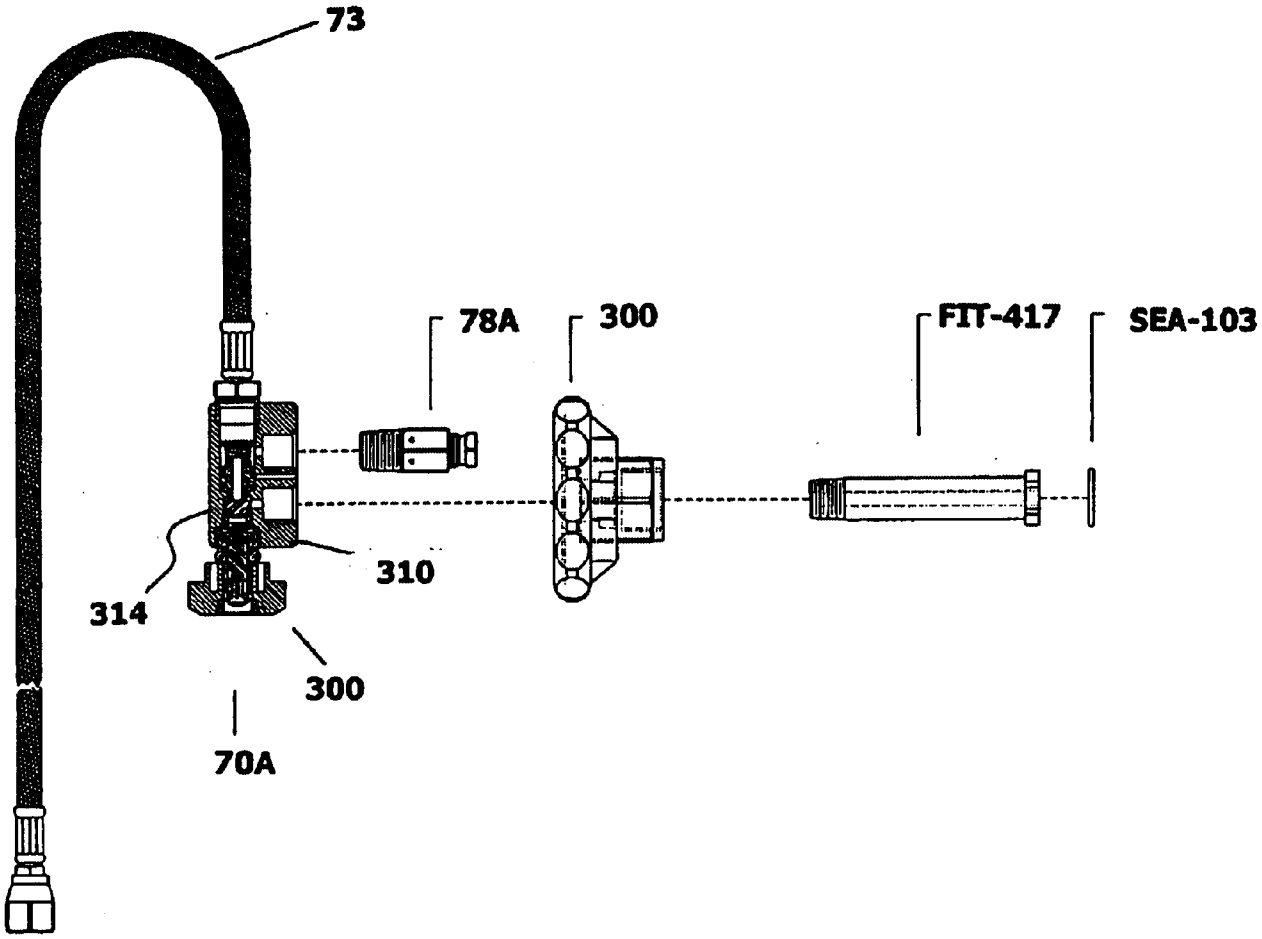

FIGS. 9A and 9B illustrate an alternate preferred embodiment of a fill valve 70A having an on\off knob 300 to shut off gas between the booster pump and a nurse cylinder before disengaging valve 70A from the nurse cylinder. The on\off knob 300 is attached to a shaft 302. A packing nut 304 acts on a bearing, such as flat plastic washer 306 against shoulder 302A of the shaft end 302B. Packing nut 304 is threaded into body 310. Interconnect member 312 is threaded also into body 310 and has a shaft engaging portion 312A for mating with shaft end 302B. Interconnect 312 member also has a seat engaging portion 312B for engaging drive seat 314. When knob 300 is rotated so as to drive interconnect member 312 further into the body, drive seat 314 engages a spring loaded sliding seat 316 at open end 316A. Sliding seat o-ring 318 is normally urged against shoulders 320 of body 310. Boosted gas will normally flow into body 310 at boosted gas supply port 322 and through channel 316B of sliding seat 316. A retainer clip 324 normally retains spring 326, which, with the boosted gas, urges the sliding seat against shoulders 320 and allows boosted gas flow through nurse cylinder supplied port 328 into the nurse cylinder. Threading knob 300 until it contacts end 316A will shut off booster gas to the nurse cylinder. Further rotation, past this point, will unseat o-ring 318 and allow built up gas in the body and upstream of the nurse cylinder shut off valve (not shown) to escape through the walls between the sliding seat and shoulders 320 and out escape port 330. Port 332 is a port for safety valve engagement for overpressurization of pressure from the booster pump.

Applicants provide unique fill valves typically for use in conjunction with the booster pump. Prior art teaches shutting off at the high pressure gas source at its source with subsequent loss of total system pressure (booster pump, lines, etc.). Applicants maintain system pressure and avoid this waste by providing fill valve 70 or any fill valve to control the flow of boosted gas at the point of use. Applicant also provides a safety valve assembly 78, or any safety valve to guard against overpressurization from trapped liquified gases, held between the double check valves 34 and 36 (See FIG. 1) and the fill valve, when the pump is not in use.

Applicant's, in FIGS. 10A and 10B illustrate how the primary piston pump assembly 18 may be constructed from several pieces so as to use less metal and to allow for making the pieces from different metals. Threaded stud RDM-34 engages threaded holes in stems 18D and 18E such that when tightened, the near ends of stems 18D and 18E seat against lips RDM-81A to provide a proper alignment of the stems with piston body 18A. FIGS. 10A and 10B also illustrate the use of "O" rings to provide gas sealing. See FIGS. 10C & 10D for an alternate preferred embodiment of primary piston pump assembly, which illustrate a single piece high pressure piston RDM-205, held in place by retaining rings LC-87. It further discloses how Teflon cap seal, SEA-109 can be placed over o-ring SEA-109A to prevent it from rolling as the piston reciprocates inside of center pump body RDM-89 (See FIG.1).

Figure 11A:
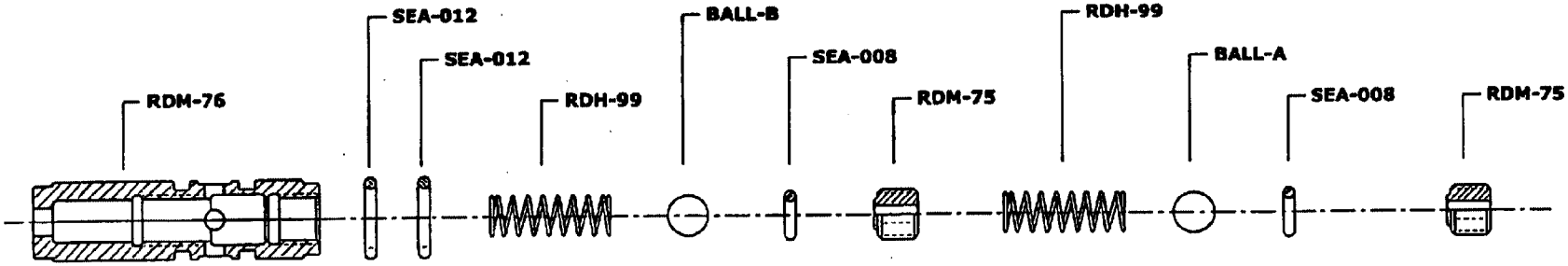
FIGS. 11A and 11B illustrate details of the double check valve cartridges of Applicants present invention.
Figure 11B:
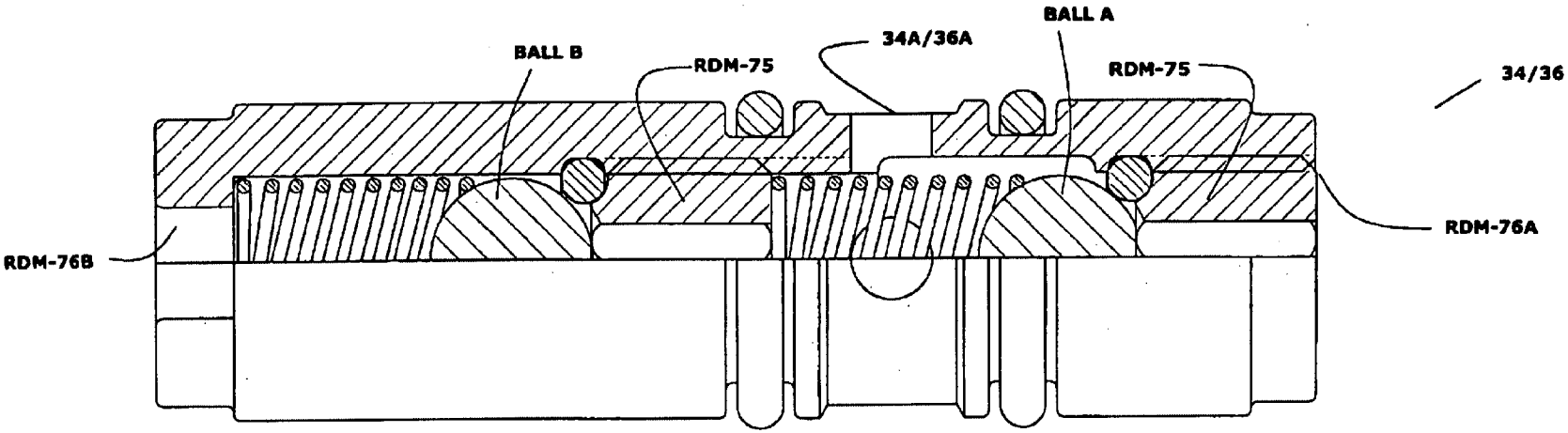

Applicant's, in FIGS. 11A and 11B, illustrate how the double check valve assemblies are constructed. Housing RDM-76 includes port 34A/36A. Two check screws RDM-75 are threaded into the body through removed end RDM-76A seating the two balls A and B and two springs RDH-99 as indicated, while also backing the two "O" rings SEA-008. Pressurized gas can enter end RDM-76A. Suction at port 34A/36A will unseat ball A and allow gas to go through port 34A/36A. Pressure at 34A/36A will unseat ball B and allow gas to flow out end RDM-76B. The o-rings SEA-012 provide for a fluid tight seal between cartridge 34/36 and chambers 38/40. Thus, Applicant provides, in a cartridge, a double check valve.

Figure 12:
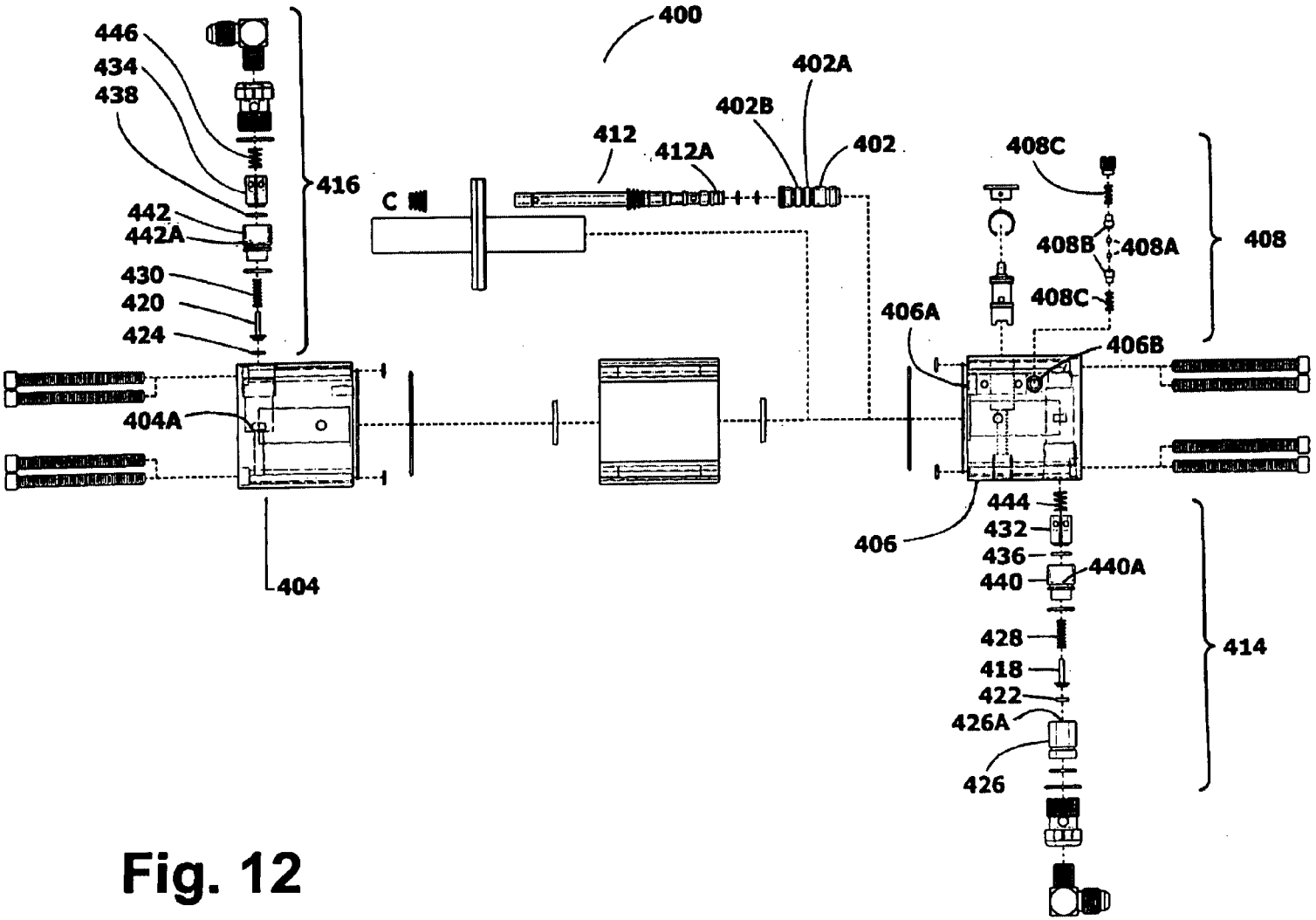
FIG. 12 illustrates an alternate preferred embodiment of the booster pump assembly.

FIGS. 12 discloses a bottom view of the alternate preferred embodiment of the booster pump disclosed in FIG. 1. However, there are three differences as set forth in more detail below.

Figure 6:
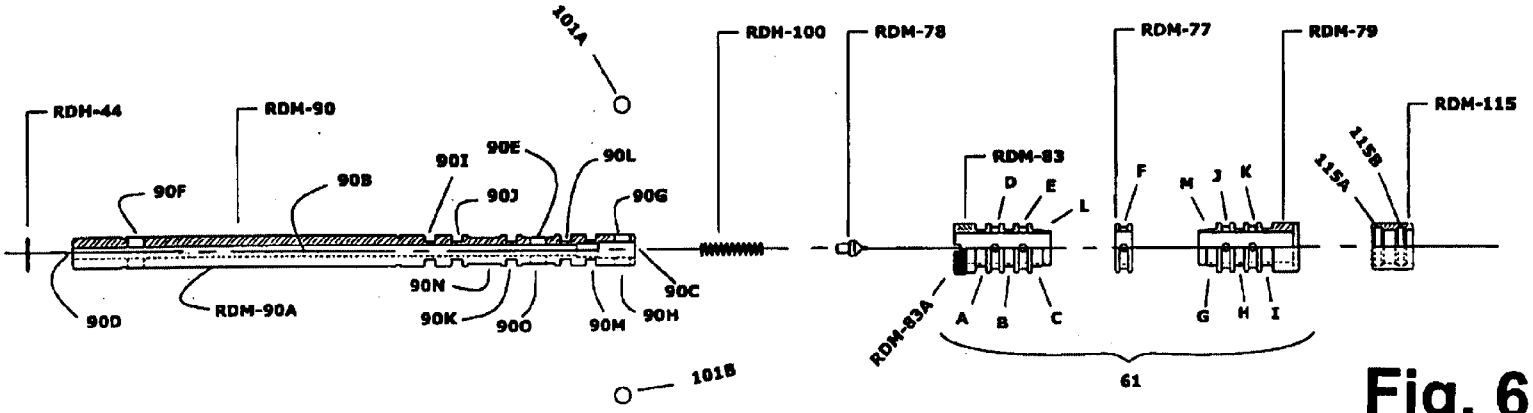
FIGS. 6 and 7 illustrate details of Applicant's cartridge stem assembly showing the two main pieces, the stem and the cartridge.

Upon closer examination of booster pump 400 as disclosed in FIG. 12, we see Applicant has provided a single piece shuttle cartridge 402 instead of the three piece cartridge 61 disclosed in FIG. 6. In the single piece shuttle cartridge 402, optional narrow slots are employed in the transfer of the drive air instead of the annualar gap created by the three individual pieces of cartridge 61 in FIG. 6. It is also noted in relation to the single piece shuttle cartridge 402 how Applicant has provided a very close tolerance fit between outer walls 402B and mating internal walls of port 406A in valved end body block 406, resulting in a nearly complete fluid tight seal between the vented bays of cartridge 402 while significantly reducing the number of o-ring seals needed to operate the pump. The small amount of bypassing drive gas does not affect the performance of the pump.

Another difference of the alternate preferred embodiment 400 is noted in the detent assembly 408, including detent balls 408A and ball housing 408B, and compression springs 408C to urge said balls towards the annular detent grooves 412A on removed end of shuttle tube 412. As can be seen in FIG. 12, valved end pump block 406 has been machined at port 406B for the receipt therein of detent assembly 408, which, at the removed end of port 406A, provides force on the outside of annular detent grooves 412A of shuttle tube 412. Thus it can be seen how Applicant has provided for internal detent grooves in one disclosure (FIG. 7) and external detent grooves in the alternate embodiment (FIG. 12), however the function of holding the shuttle tube into one position or the other is demonstrated in both embodiments.

In the final disclosure of FIG. 12, Applicant has provided double check valve assemblies 414 and 416 produced from individual valve components instead of the cartridge type disclosed in FIGS. 11A and 11B. These alternate check valve assemblies 414 and 416 function similar to previous disclosure 34/36 (See FIG. 11B) by allowing suction pressure into the high pressure chamber thru the first valve and allowing boosted pressure to escape thru the second valve on the compression stroke of the pump. However, instead of using balls to seat against o-rings as disclosed in FIG. 11B, Applicants alternate embodiment create the first valves using piston 418/420 in conjunction with o-rings 422/424 respectfully, to seal against flat surfaces 426A/404A on stationary tube 426 and unvalved end block 404, respectfully said pistons urged by compression springs 428/430. The secondary valves are created using pistons 432/434 in conjunction with o-rings 436/438 to seal against removed end 440A/442A respectively of stationary valve guides 440/442 respectively, with springs 444/446 urging said pistons towards their respective sealing surfaces. The remaining o-ring seals and outlet fittings are provided as static fluid tight seals in view of pump operation.

Figure 13:
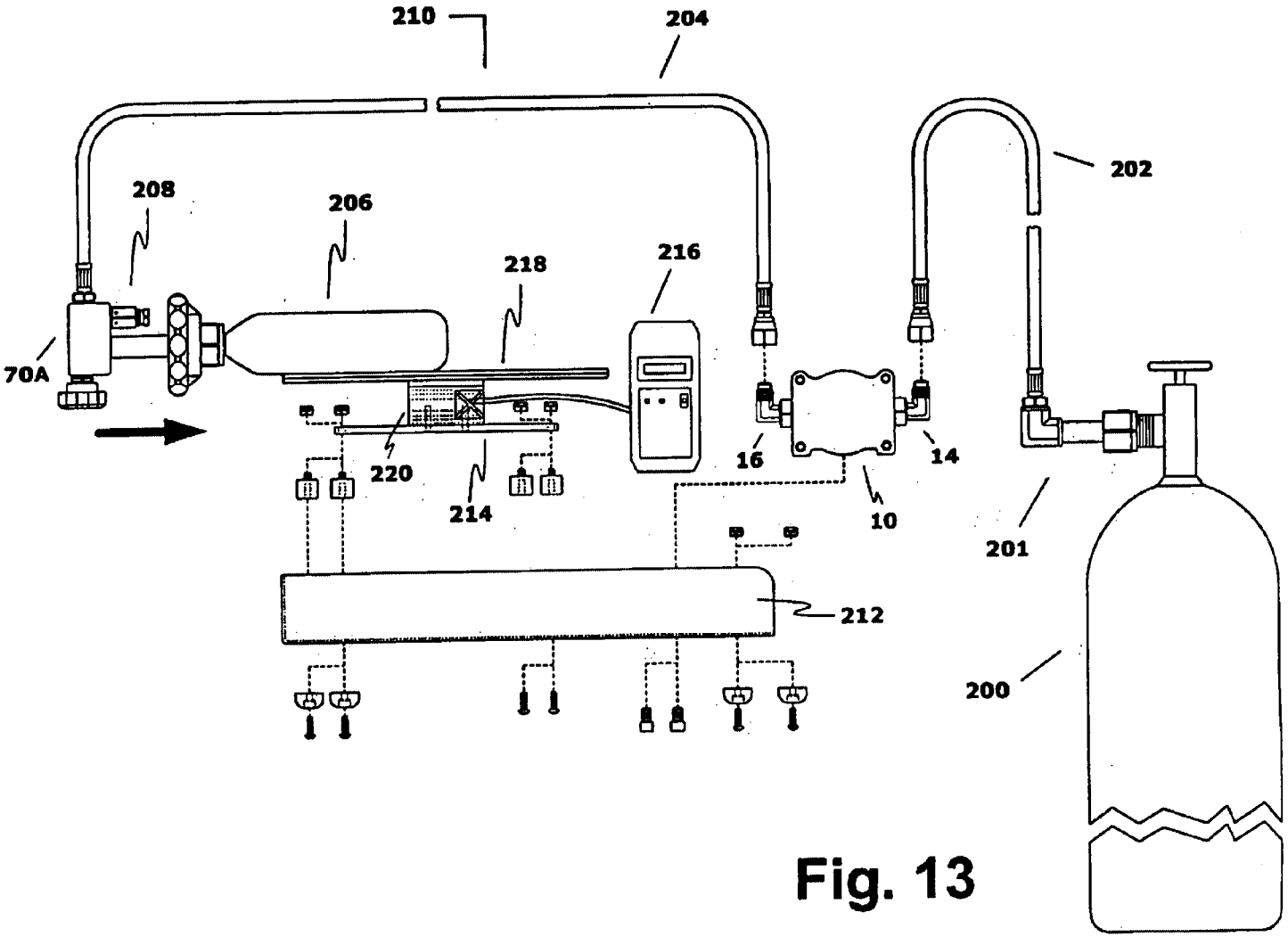
FIG. 13 illustrates the complete transfill station.

In FIG.13 Applicant discloses a transfill station 210. The function of the transfill station is to provide a single integral assembly for filling, from mother tank containing high pressure gas, to a nurse cylinder with liquified gas or a gas at a boosted pressure. What the prior art lacks is a single assembly which locates and supports the elements necessary for filling a nurse tank or cylinder at a boosted pressure from the gas or liquified gas, of a mother tank.

A mother tank 200 contains a high pressure gas such as $CO_2$ or $NO_2$. A high pressure supply line 202 is connected to the mother tank through a mother tank connection 201. The removed end of the high pressure supply line 202 is attached to the high pressure inlet assembly 14 of a booster pump such as Applicant's booster pump 10 (or any other booster pump). A boosted gas supply line 204 is attached at one end to the boosted gas outlet assembly 16 of the booster pump. At the removed end of the boosted gas supply line is a nurse cylinder fill valve such as, for example, alternate preferred embodiment of fill valve 70A (See. FIG. 9B), or any other fill valve. A nurse cylinder 206 will be filled using Applicant's unique transfill station 210. The fill valve may contain a safety valve 208 to prevent over pressurizing the hose (See FIG. 9B for further details of a safety valve).

Applicant's unique transfill station 210 includes a tray or platform 212 on which a number of elements are mounted. This tray or platform provides for a base and a physical location of the elements of the transfill station that make the transfill station a simple, easy, affordable and self-contained unit for filing a nurse cylinder from a mother cylinder.

Onto the tray or platform 212 is mounted a booster pump such as Applicant's booster pump 210 or any other booster pump. The booster pump typically includes the high pressure supply line and the boosted gas supply line 202 and 204 respectively. Also, at the removed end of the boosted gas supply line is typically located a fill valve.

Adjacent to booster pump and mounted to the tray platform is a scale, for measuring the weight of the nurse bottle or nurse cylinder which is typically placed on the upper surface thereof. The scale includes an upper platform 218 for placement of the nurse bottle thereupon and typically mounted below the upper platform a sensor 220, which will provide an output signal, the output signal a function of the weight of the bottle or nurse cylinder placed on the scale. Connection by an appropriate wire conductor to the sensor is a meter head controller 216 which will display the weight of whatever is placed upon the scale.

Meter head controllers and scales are commercially available from known sources. Applicant has provided, in a single integral unit, a tray or platform for mounting a booster pump scale and a scale readout or meter head controller thereon. This unit, with the appropriate supply line provided, means that a user may easily transport the unit and has all the elements necessary for filling a nurse cylinder from a mother cylinder. Mother cylinders are often large and unweildly so Applicant provides, in a single transfill station 210 a scale, scale readout, booster pump and the necessary lines to connect the booster to the mother cylinder and the nurse cylinder.

Although the invention has been described with reference to specific embodiments, this description is not meant to be construed in a limited sense. Various modifications of the disclosed embodiments, as well as alternative embodiments of the inventions will become apparent to persons skilled in the art upon the reference to the description of the invention. It is, therefore, contemplated that the appended claims will cover such modifications that fall within the scope of the invention.

We claim:

1. A pneumatically driven booster pump comprising:

a double ended piston having a central body, the central body having a pair of drive faces, the double ended piston having a pair of removed ends, each of the removed ends with a driven face thereon;

at least one shuttle valve for transferring a drive gas from one of the pair of drive faces to the other of the pair of drive faces; and a body housing including a piston chamber for enclosing the double ended piston, walls defining a chamber for enclosing within the body housing the shuttle valve, an inlet port for receiving a fluid to be boosted and an outlet port for providing the boosted fluid at a pressure greater than the pressure that it was received at the inlet port;

wherein the piston is adapted to slidably receive the shuttle valve through the central body of the piston.

2. The booster pump of claim 1 further including a manual valve for providing a drive gas to the shuttle valve.

3. The booster pump of claim 1 further including a fill valve capable of filling a cylinder.

4. The booster pump of claim 1 further including a double check valve to control the flow of booster gas to and from the piston chamber.

5. The booster pump of claim 1 further including a member for engaging the shuttle valve so as to move the shuttle valve and overcome a stalled condition.

6. The booster pump of claim 1 further including a double-check valve, enclosed within a cartridge for insertion within the body of the booster pump to control the flow of boosted gas to and from the piston chamber.

7. A pneumatically driven booster pump comprising:

a double ended piston having a central body, the central body having a pair of drive faces, the double ended piston having a pair of removed ends, each of the removed ends with a driven face thereon;

at least one shuttle valve for transferring a drive gas from one of the pair of drive faces to the other of the pair of drive faces;

a body housing including a piston chamber for enclosing the double ended piston, walls defining a chamber for enclosing within the body the shuttle valve, an inlet port for receiving a fluid to be boosted and an outlet port for providing the boosted fluid at a pressure greater than the pressure that it was received at the inlet port; and means for engaging the shuttle valve so as to move the shuttle valve and overcome a stalled condition.

8. The booster pump of claim 7 wherein at least one shuttle valve slideably engages the central body of the double ended piston to alternately shuttle drive gas from one side of the central body of the piston to the other side.

9. The booster pump of claim 7 further including a valve for controlling entry of the drive gas into the body housing, the valve adapted to require manual depression to achieve flow of the drive gas into the body of the booster pump.

10. The booster pump of claim 7 further including a fill valve capable of filling a cylinder.

11. The booster pump of claim 7 further including a double check valve to control the flow of booster gas to and from the piston chamber.

12. The booster pump of claim 7 further including a member for engaging the shuttle valve so as to move the shuttle valve and overcome a stalled condition.

13. The booster pump of claim 7 further including a manual valve for providing a drive gas to the shuttle valve.

14. The booster pump of claim 7 further including a double-check valve, enclosed within a cartridge for insertion into the body of the booster pump to control the flow of boosted gas to and from the piston chamber.

* * * * *